United States Patent [19]

Coley

[11] 4,050,754

[45] Sept. 27, 1977

[54] BOOK EJECTION APPARATUS

[76] Inventor: Charles L. Coley, 1303 Summertime Lane, Culver City, Calif. 90230

[21] Appl. No.: 612,944

[22] Filed: Sept. 12, 1975

[51] Int. Cl.[2] ..... A47B 23/00

[52] U.S. Cl. ..... 312/319; 312/18; 312/15; 248/441 R

[58] Field of Search ..... 312/10, 12, 15, 319, 312/333, 18; 211/13, 40, 41, 42; 206/387

[56] References Cited

U.S. PATENT DOCUMENTS

| | | | |
|---|---|---|---|
| 1,033,014 | 7/1912 | Holstein | 312/15 |
| 1,250,887 | 12/1917 | Jerum | 312/10 |
| 1,310,814 | 7/1919 | Ward | 312/10 |
| 1,393,284 | 10/1921 | Henry | 312/18 |
| 1,850,790 | 3/1932 | Cunningham | 312/12 |
| 2,620,929 | 12/1952 | Sportsman | 211/43 UX |
| 2,639,957 | 5/1953 | Geller | 312/319 |
| 2,667,399 | 1/1954 | Swimmer | 312/319 |
| 2,899,250 | 8/1959 | Mark | 312/319 |
| 2,980,481 | 4/1961 | Fisher | 312/250 |
| 3,021,637 | 2/1962 | Huffman | 248/441 C |
| 3,066,993 | 12/1962 | Mark | 312/319 |
| 3,180,697 | 4/1965 | Mulch | 312/10 |
| 3,387,713 | 6/1968 | Brooks | 211/42 |
| 3,836,222 | 9/1974 | Kuntze | 312/10 |
| 3,854,784 | 12/1974 | Hunt | 312/10 |

FOREIGN PATENT DOCUMENTS

| | | | |
|---|---|---|---|
| 632,007 | 12/1961 | Canada | 211/43 |

*Primary Examiner*—Paul R. Gilliam
*Assistant Examiner*—Victor N. Sakran
*Attorney, Agent, or Firm*—Booker T. Hogan, Jr.

[57] ABSTRACT

A device for use in a conventional book case to eject a book upon demand.

9 Claims, 7 Drawing Figures

BOOK EJECTION APPARATUS

BACKGROUND OF THE INVENTION

1. Field of the Invention

The invention is related to bookcase and bookcase accessories in general. In particular it relates to a book retrieval or ejection system. A novelty search was conducted in the following cases and subcases; Class 108, Sub 136; Class 211, Sub 42 Class 221, Sub 23 and 134; Class 248, Sub 441 and Class 312, Sub 233 and 319.

2. Prior Art

Conventionally, bookcases are designed to hold a multiplicity of books in a vertical position with their edges or back facing the front. Access to a book is obtained by using the fingers to clasp the edge or end of the book and exerting a pulling force to remove the book from the shelf.

In those instances, (such as the shelves of an institutional library) where the books are closely packed into the shelf and of a uniform size, it is sometimes difficult to grasp a particular book by its back. Attempts to do so have resulted in countless broken finger nails.

Hooks, clamps and other similar devices are generally unsatisfactory because of their propensity for damaging the binding of the book.

Applicant knows of no prior art which attemps to solve the problem as defined above. The closest art in principal is that of U.S. Pat. No. 2,677,399 by A. T. Swimmer disclosing an extension leaf for furniture. The teachings of this art are inapplicable to applicants, invention which allows one to remove a single book at random from a multiplicity of books

THE INVENTION

Summary of the Invention

An object of this invention is to provide a means to facilitate the retrieval of a book from a bookcase containing a multiplicity of books. Another object of this invention is to achieve the first objective in a manner which precludes the rupturing of fingernails occasioned by grasping the edge of and exerting a pulling force on a book closely packed in a bookcase. A still further objective of this invention is to achieve the above objectives in a manner which does not rupture the binding of the book being retrieved.

In meeting the above objectives, a book ejection system for use in conventional book case which utilizes an action-reaction principal to expell or eject a book from its position on a bookshelf has been invented.

The invention is a false backing, having a resilient character, sized to fit into a bookcase between the true back of the bookcase and books placed in the case or on the shelf of the case.

The application of an inward force onto the edge or back of a book sufficient to cause the book to compress the false backing will energize the backing whereby the backing will react to the release of the applied inward force by exerting an outward force on the book used to energize the system. Such a force will cause only the book to be expelled or ejected from the row of books in the case.

Brief Description of the Drawings

The exact nature of this invention as well as other objects and advantages thereof will be readily apparent from consideration of the following detailed description relating to the annexed drawing in which.

Detailed Description

The need for an inexpensive system or apparatus for expelling books from a bookcase upon demand is readily apparent. The following invention description discloses such a system.

It can be shown that an energizing force of less than ten pounds is sufficient to overcome the static and sliding friction of a typical hard cover novel, text, or reference book standing on its end in a closely, but not tightly packed bookcase. When such a force is applied to a reactive system through a book, the system will exert a reactive force of a comparable order of magnitude in a direction opposite that of the energizing force. If there are no restraining forces present when the reactive force is exerted, this force will impart a momentum to a typical hard cover book sufficient to cause it to be expelled from ½ to 2 inches further than its initial point or place of rest on the hard surface of the book shelf. The book may then be grasped by both sides and removed from the shelf.

The ejection of a book in the manner disclosed above may be accomplished with any one of several systems which utilize this "Action-Reaction" principal. Various reaction means or compression resistant means having reactive characteristics may be employed. These means include but are not limited to spring means such as compression springs, leaf springs, belleville springs, volute springs, torsion bars, and cellular elastomeric materials. The system may or may not be permanently attached to the bookcase.

Figure 1:
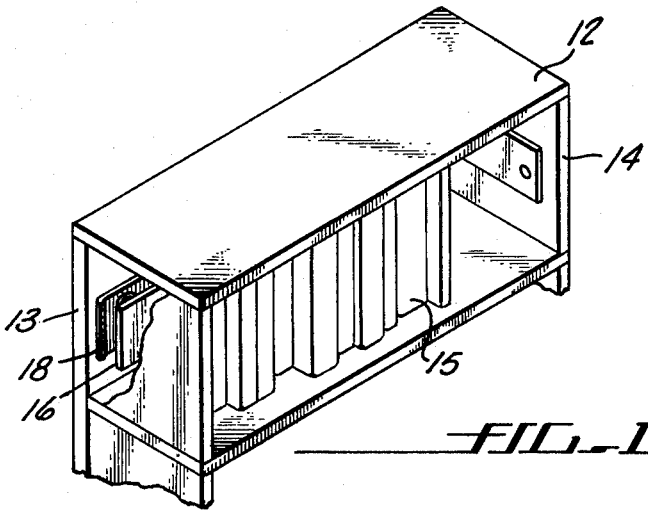
FIG. 1 shows a perspective view of a conventional bookcase having one species of the invention.
Figure 2:
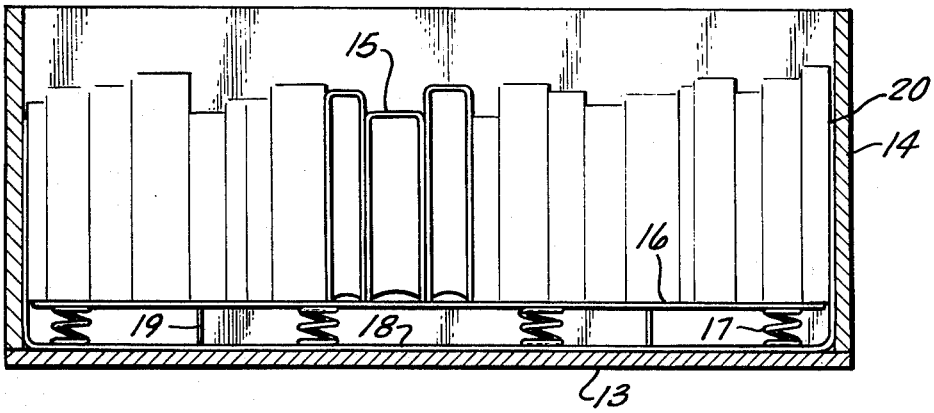
FIG. 2 is a plan view of the invention in an unenergized state mounted in a conventional bookcase.

Referring to FIG. 2 one may readily understand the nature of this invention. A rectangular shaped front panel 16 is connected to a similar shaped rear panel 18 by a series of compression springs 17. The front panel 16 should be rigid although the rear panel 18 need not be. Typical panel structural materials include but are not limited to plastic, aluminum and wood sheetings. A bingee 19 is used to maintain a predetermined spaced relationship between the front and rear panels. Bingees maybe fabricated from any flexible material having a low expansion factor. Suitable materials include, metallic wires, chains or rings. Certain fibrous materials would also work.

The number and spacing of the compression springs 17 will vary with the specifications of the springs. i.e., fewer springs are needed when the rate load per inch of each spring compression is increased.

If numerous springs are employed, a degree of lateral and vertical stability is achieved which eliminates the necessity of providing a tracking means between the ends of the front panel 16 and the inner sides of the book case 14.

Figure 3:
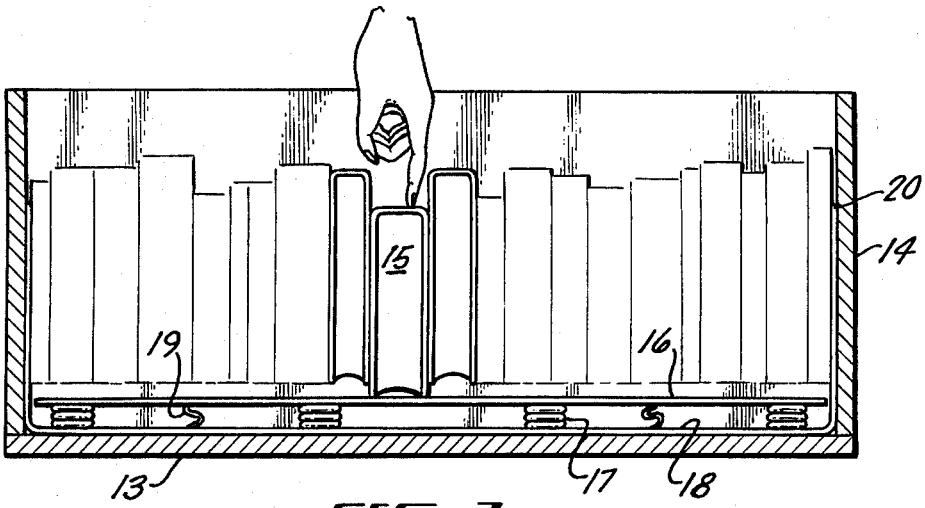
In FIG. 3, a plan view of the invention in an energized state is shown.
Figure 4:
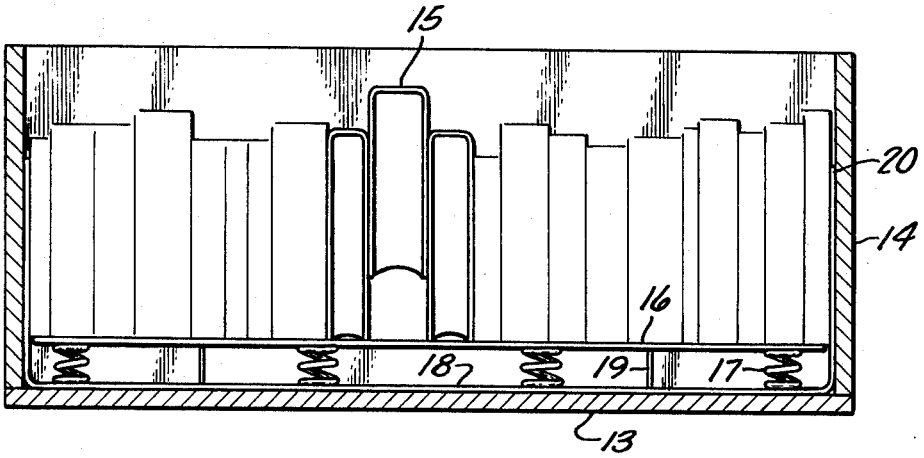
FIG. 4 shows a plan view of the invention after the energizing force has been removed and the invention has reacted by expelling the book used to transmit the energizing force to the invention.

The system shown in FIG. 2–4 utilizes few springs. Therefore side extensions 20 of the rear panel 18 are shown. These extensions may be coated with an anti-friction material in the vicinity of the front panel to preclude a "sticking" or "hanging up" phenomena when the front panel is deflected in an unsymetrical manner whereby it comes in contact with the side extension 20.

The system shown in FIG. 2–4 may be attached to the bookcase via suitable fastening means inserted through the rear panel 18 into the back of the bookcase 13 or through the side extensions 20 into the side of the bookcase 14.

In operation, a force is applied to a hardcover book, 15 placed or positioned in the bookcase such that the top and bottom cover of the book is resting against or immediately adjacent to the front panel 16, thereby causing the front panel 16 to compress the compression springs 17 as shown in FIG. 3. When the force is removed, the compressed springs 17 will react against the front panel 16 causing it to push the book 15 towards the front of the case with a force sufficient to impart a momentum to the book which will not be immediately disipated. This momentum will cause the book to move to a new position on the shelf which will allow one to grasp its edge with no difficulty. The forward motion of the front panel 16 is terminated when the distance traveled is equal to the length of the flexible bingee 19 and other books on the shelf will be undisturbed.

Figure 5:
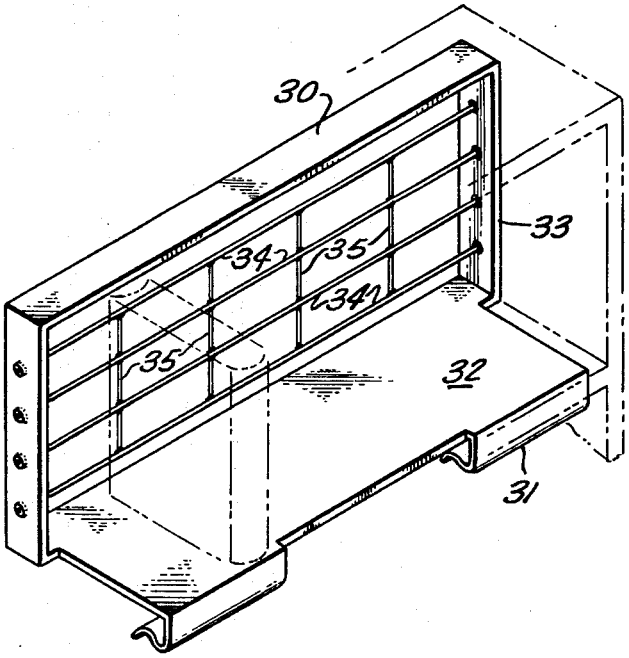
In FIG. 5, a plan view of a species of the invention designed for use with "open back" book cases is shown.
Figure 6:
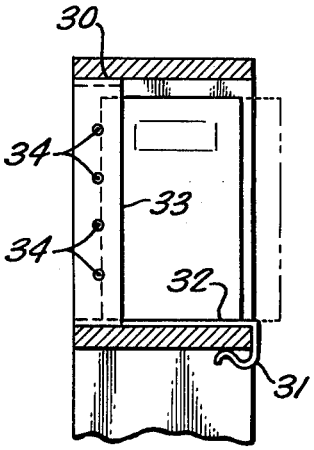
FIG. 6 is a side elevation of the species shown in FIG. 5.

An embodiment of this invention, suitable for use in "open back" bookcases of the type found in the stacks of large libraries, is shown in FIG. 5. Hence a vertical frame composed of a rectangular top member 30 and two rectangular side members 33 is mounted onto a flat base 32 having a "J" shaped front edge 31. Spring steel wires 34 are tightly strung at fixed intervals between the side members 33. These wires maybe inter-connected by other spring steel wires 35 to impart dimensional stability.

In operation, the "open back" system functions in a manner similar to that compression spring system. However, currently designed "open back" systems have the disadvantage of exhibiting "dead zones" within 1 to 2 inches of the side members. The "dead zones" are an inherent result of the method of attachment used to mount the spring steel wires in the frame. Books placed on either end of a bookcase having this system may not be used to energize the spring steel wires. Various techniques for eliminting this disadvantage are being studied.

Figure 7:
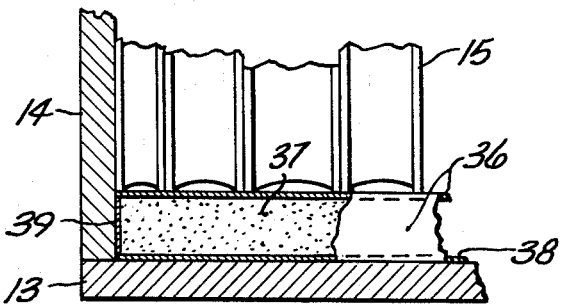
FIG. 7 is a plan view of an embodiment of the invention where the reactive means is an elastomeric material.

Another embodiment of this invention takes the form of a retangular shaped pad fabricated from a cellular elastomeric material. A model of this embodiment, fabricated from a polyurethane foam, was originally used to test the basic inventive concept. This type of system has the advantage of being completely silent in its operation. It functions by utilizing the same action-reaction principal discussed above. FIG. 7 shows a cross section of this system.

Suitable elastomeric materials 37 are selected on the basis of their compression resistance values at 25% deflection (a compression resistance factor of more than 5 psi will generally be adequate), and low compression set value. Prototype systems have been made with open cell elastomeric materials. However, cored, expanded or uncored materials maybe used.

In order to preserve the structural integrity of the material employed, a thin vinyl, or other similar material, covering may be used 36. Care must be taken to allow the material to breath. Therefore, the sides of the covering 39 should be perforated. The back of the covering 38 may be the same as the front or it may be rigid.

In practice, one sizes his pad to fit into a conventional bookcase along the back panel. A small dab of an adhesive will hold it in place thereby creating a resilient backing for the bookcase which functions with the action-reaction principal discussed above.

Having completely disclosed my invention and provided exemplary description of various embodiments of this invention, the score of my claims may now be understood as follows.

I Claim:

1. A book ejection system for use in a bookcase having a front and back and having at least one horizontal shelf, and two vertical sides comprising compression resistant means having reactive characteristics mounted to the back of said bookcase substantially orthogonal to said horizontal shelf, whereby when books are positioned in a first position on said horizontal shelf against said compression means and a book is moved with a force against said compression means and released, said book will be moved foward in a direction away from said compression means to a position forward from said first position.

2. The system of claim 1, where said compression resistance means is comprised of a cellular elastomeric material covered with a thin flexible first material connected to a second material by a porous flexible third material.

3. The system of claim 2, where said cellular material is foam rubber.

4. The system of claim 3, where said third material is a muslin cloth.

5. The system of claim 1, wherein said compression resistant means is comprised of a rectangular shaped front panel maintained in a spaced relationship with respect to a rectangular shaped back panel by a spring means and at least one bingee mounted between and connected to each of said panels.

6. The system of claim 5, wherein said spring means is a multiplicity of spring taken from the group consisting of compression springs, leaf springs, belleville springs, and volute springs.

7. The system of claim 5, wherein said spring means is a torsion bar.

8. A book ejection system for use in a book case having at least one horizontal shelf, two vertical sides and at least one vertical back plate comprising a rectangular shaped back panel mounted on said vertical back plate substantially parallel thereto, compression resistant means having reactive characteristics mounted on said rectangular shaped back panel and a rectangular shaped front panel mounted on said compression resistant means substantially parallel to said back panel and maintained in a spaced relationship with respect to said back panel by at least one flexible bingee whereby when books positioned on said horizontal shelf susstantially against said front panel are pushed toward said vertical back panel and released, said book will be moved in a direction away from said back panel to a position spaced from said front panel by the reactive force of said compression resistance means.

9. The system of claim 8, wherein said front panel is a rigid panel and said compression means is a multiplicity of spring means taken from the group consisting of compression springs, leaf springs, belleville springs, volute springs, torsion bars and cellular elastomeric materials.

* * * * *